United States Patent [19]

Spence-Bate

[11] 4,178,089

[45] Dec. 11, 1979

[54] PHOTOGRAPHIC DEVELOPER

[76] Inventor: Harry A. H. Spence-Bate, 1 Cheam Pl., Morley, Western Australia, Australia, 6062

[21] Appl. No.: 865,595

[22] Filed: Dec. 29, 1977

[30] Foreign Application Priority Data

Dec. 30, 1976 [GB] United Kingdom ..... 54345/76
Mar. 23, 1977 [GB] United Kingdom ..... 12278/77
Apr. 19, 1977 [GB] United Kingdom ..... 16273/77

[51] Int. Cl.[2] ..... G03D 3/04

[52] U.S. Cl. ..... 354/319; 354/324; 354/328; 354/331; 134/88; 134/114

[58] Field of Search ..... 354/300, 307, 312, 315, 354/316, 317, 319, 320, 321, 322, 323, 324, 325, 326, 328, 331, 332; 134/84, 88, 91, 97, 98, 114, 122 P, 64 P

[56] References Cited

U.S. PATENT DOCUMENTS

| | | | |
|---|---|---|---|
| 2,077,081 | 4/1937 | Tondreau et al. | 134/122 P |
| 2,918,069 | 12/1959 | Brown et al. | 354/319 |
| 3,067,758 | 12/1962 | Hersh | 134/114 |
| 3,095,798 | 7/1963 | Kelly | 134/122 P |
| 3,516,345 | 6/1970 | Meyer | 134/64 P |
| 3,538,835 | 11/1970 | Needleman | 354/323 |
| 3,593,640 | 7/1971 | Gall | 118/314 |
| 3,792,488 | 2/1974 | Katakabe | 354/300 |
| 3,886,576 | 5/1975 | Stoffel | 354/323 |
| 4,068,249 | 1/1978 | Degenhardt et al. | 354/300 |
| 4,092,658 | 5/1978 | Schroter | 354/300 |

*Primary Examiner*—L. T. Hix
*Assistant Examiner*—Alan Mathews
*Attorney, Agent, or Firm*—Fidelman, Wolffe & Waldron

[57] ABSTRACT

A photographic developer for sheet film arranged to feed the film through two or more interconnected chambers sealed by seals at the inlet of the first chamber and the outlet of the final chamber and also sealed at the interconnection of the chambers by means of seals which are preferably rotatable and controlled by a single motor, the seals preferably having rotatable valves at one end which control the inlet and outlet of developing and fixing agents as well as a drying gas.

8 Claims, 16 Drawing Figures

PHOTOGRAPHIC DEVELOPER

The present invention relates to photographic developers for developing and fixing film.

High speed photographic cameras, particularly microfiche cameras, are capable of exposing film at increasingly high rates and the corresponding provision of high speed developing units therefore becomes very important.

According to the invention a photographic developer is provided with a first chamber and a second chamber in intercommunication with the first chamber and separated therefrom by a fluid seal, the first chamber having an inlet seal and the second chamber having an outlet seal, the chambers having fluid inlets and outlets for continuously feeding fluids therethrough.

Preferably, the first chamber is above the second chamber and is aligned therewith so that a film being developed may be fed downwards from chamber to chamber past the fluid seal.

In one preferred embodiment that are fluid inlets and outlets on both sides of the chambers, and the inlet to the first chamber is sealed by a pair of rollers.

According to another aspect of the invention a method of developing film comprises feeding exposed photographic film through an inlet seal into a first chamber in intercommunication with a second chamber separated from the first chamber by a fluid seal, passing a developer through the first chamber, washing the film, fixing the film in the second chamber, further washing the film, and drying the film.

Preferably, the film is washed in the first chamber after developing and the film is dried in the second chamber by emptying the second chamber and passing a drying gas around the film. Alternatively, drying can be carried out in a further chamber interconnected to the second chamber. Alternatively the developing and fixing process may be carried out in the first chamber whilst using the second chamber for washing and drying the film.

In a further embodiment the seals at either end of the chambers which are constructed so as to be rotatable by one or more motors, which motor or motors synchronously drive valve assemblies for controlling the feed of liquid into the chambers.

In a further embodiment the liquid seals comprise a first rotatable gate in an entry to a first chamber in which developing and fixing may be carried out, a second rotatable gate between an exit to the first chamber and an entry to a second chamber in which washing may be carried out, and a third rotatable gate in an exit to the second chamber.

In a further embodiment the third rotatable gate only acts as a film seal since liquid is allowed to by-pass the third gate for drainage purposes.

Development of the film may be carried out by means of a liquid born developing agent, or a gas born developing agent.

Furthermore, it is possible to use a gas born fixing agent or a liquid born fixing agent.

The advantages of using gas born developing and fixing agents in the developers according to the invention is that the drying by means of a drying gas may be carried out in a shorter time than when liquid born developing and fixing agents are used.

The invention will now be described with reference to the accompanying drawings, in which.

Figure 2:
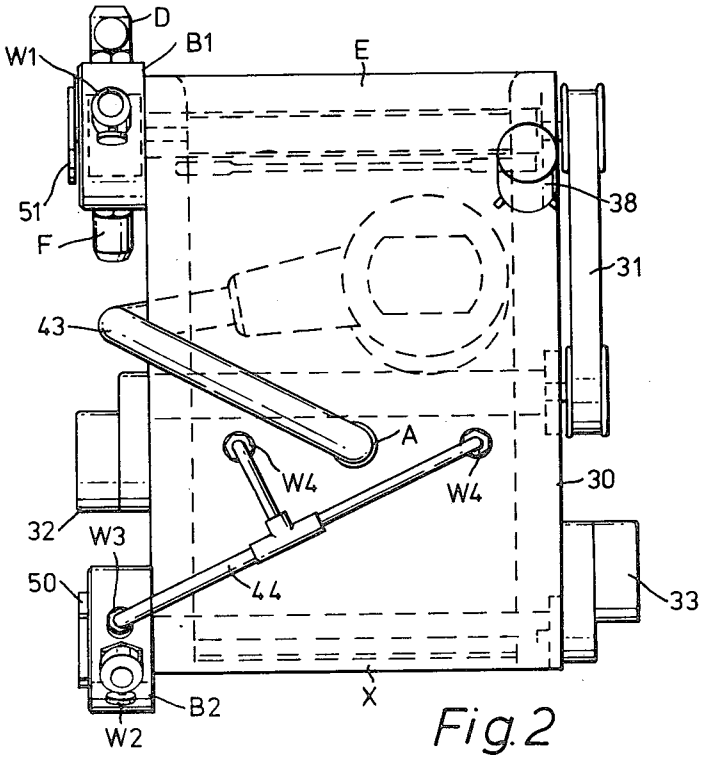
FIG. 2 shows a rear elevation of the developer according to a second embodiment of the invention.

FIG. 6A to G diagrammatically shows the gating and porting operation of the first and second gates either side of the first chamber of the developer of FIG. 2; and FIG. 7A to D shows diagrammaticaly the gating and porting arrangements of the second and third gates either side of the second chamber of the developer of FIG. 2.

Figure 1:
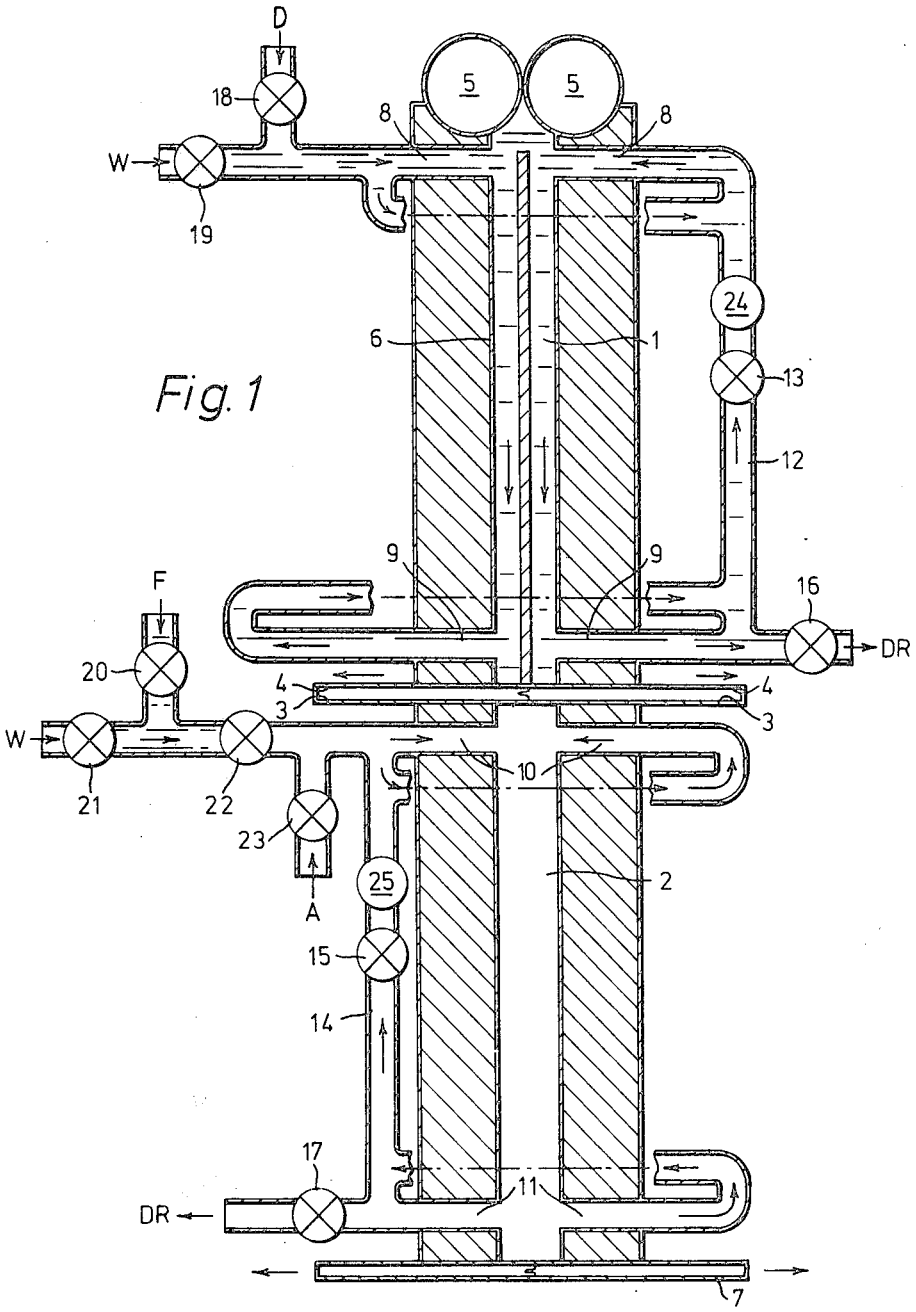
FIG. 1 is a schematic cross-sectional elevation of a first embodiment of the invention.

In FIG. 1 there is shown a first or upper developing chamber 1 and a second or lower fixing chamber 2, both of which are aligned and in intercommunication with each other, but separated by a liquid seal 3 formed by two intercooperating leaves 4. At the upper end of the developing chamber 1 an inlet seal is formed by two resilient rollers 5 which, apart from sealing the upper end of the developing chamber, assist in feeding a film 6 into the developing chamber. At the lower end of the fixing chamber 2 an outlet seal 7 is provided which is similar to the liquid seal 3. The developer chamber 1 has inlets 8 provided on both sides and outlets 9 also on both sides. Similarly, the fixing chamber 2 has, on both sides, inlets 10 and outlets 11. Interconnecting the inlets and outlets of the developer chamber 1 is a recirculating duct 12 which can be opened or closed by means of a valve 13. Similarly, the fixing chamber 2 is provided with a recirculating duct 14 controlled by a valve 15. Drain valves 16 and 17 are provided for the outlets 9 and 11 of the chambers 1 and 2 respectively, for closing the drains when the recirculating valves 13 and 15 are open. A developer insert valve 18 is provided at the upper end of the developing chamber, together with a water inlet valve 19. At the inlet to the fixing chamber there is provided a fixer insert valve 20, a water inlet valve 21, a check valve 22 and an air inlet valve 23. In order to assist recirculation, pumps 24 and 25 are provided in the recirculating ducts 12 and 13 respectively.

To operate the developer, water is passed through the upper chamber 1 with valves 19 and 16 open and 18 and 13 closed. At the same time water is passed through the lower chamber 2 through valves 21 and 17 with valve 22 open and valves 20, 23 and 15 closed. The water pressure at valves 19 and 21 is at the water mains pressure. A film 6 is then inserted into the upper chamber by rotation of the rollers 5 and valve 13 is opened at the same time as valves 19 and 16 are closed. The recirculating pump 24 is operated and developer is metered through valve 18 so that developer is now circulated through the upper chamber 1 on both sides of the film 6, which is supported clear of the sides of the chamber by the flow of developing liquid. Developing then continues at a controlled temperature with a controlled concentrate of developing liquid for a predetermined time. Each of these parameters can be adjusted to achieve the correct development.

When developing is near completion recirculation by means of pump 24 is stopped, valve 19 is opened and the developer is purged through valve 16. The film is then washed for a given time until the seal is opened, allowing the film 6 to float into the lower chamber 2.

Entry into the lower chamber 2 is suitably monitored by means of a light projecting through the walls of the chamber 2 and operating a photoelectric cell.

On entry to the lower chamber 2 the liquid seal 3 is closed and the washing can either be continued or else a fixing cycle can be commenced in a similar way as the developing cycle. After the fixing cycle is completed a further washing cycle is carried out in the lower chamber in a similar fashion to the washing cycle in the upper chamber. On completion of the washing cycle in the lower chamber, all liquid is drained out of the lower chamber, valve 22 is shut, valve 17 remains open and valve 23 is opened to admit warm drying air into the lower chamber. This dries the film and on completion seal 7 is opened to allow the film to drop out of the lower chamber.

In order to increase the speed of operation it may be necessary to increase the number of chambers and include a further drying chamber below and in line with the fixing chamber 2. Further chambers can also be provided for developing colour film.

Figure 3:
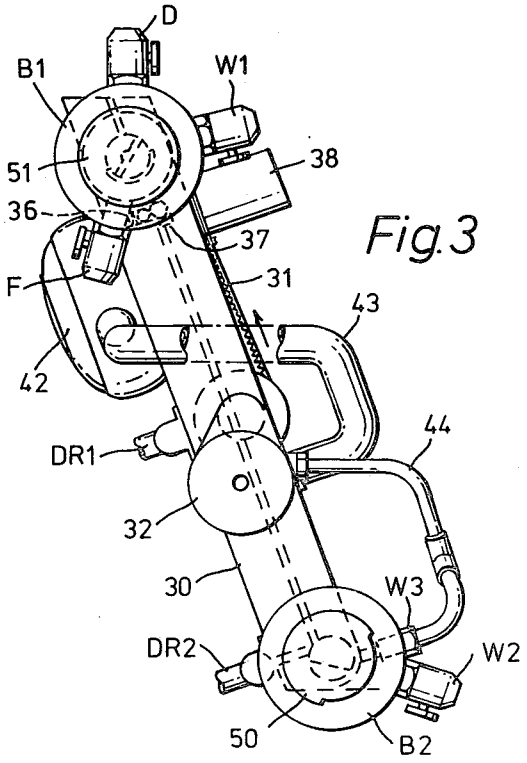
FIG. 3 is a side elevation of the developer of FIG. 2.
Figure 4:
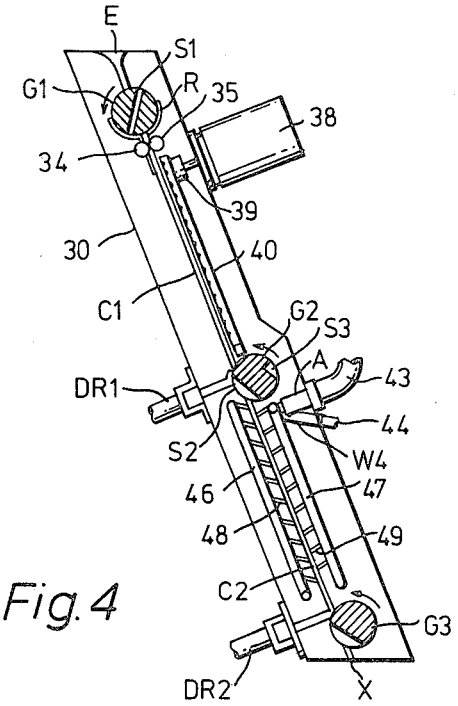
FIG. 4 is a side elevation of the developer of FIG. 2 showing the internal arrangements.
Figure 5:
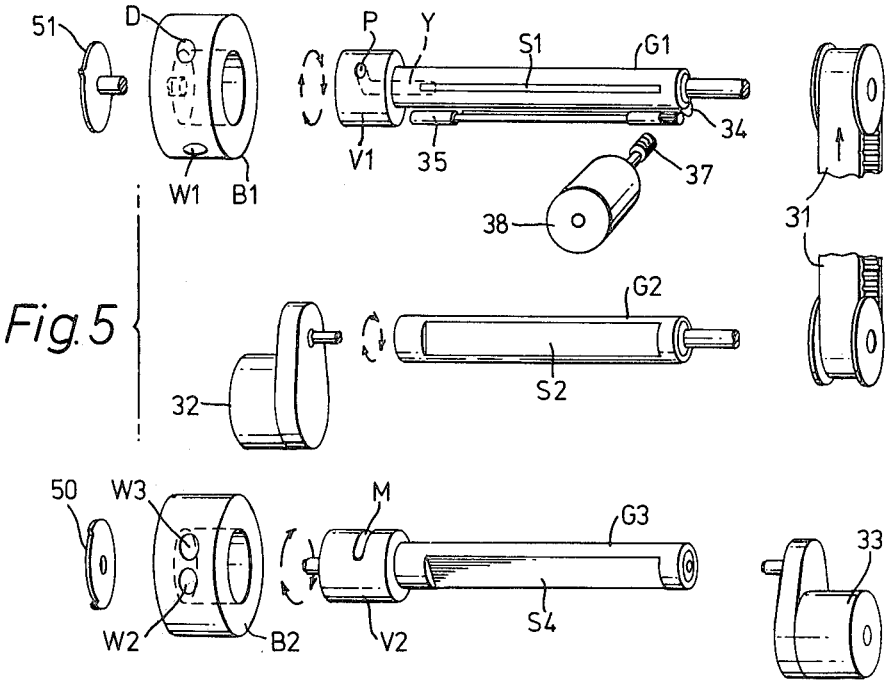
FIG. 5 shows the gating arrangements of the developer of FIG. 2.

In FIGS. 2 to 4 can be seen a second developer 30, in which is provided a first and upper chamber C1 and a second and lower chamber C2. In an entry E to the first chamber C1 is a rotatable gate G1 and between an exit to chamber C1 and an entry to chamber C2 is a second rotatable gate G2. A third rotatable gate G3 is provided in an exit X to the second chamber C2. Gates G1 and G2 are coupled for rotation by means of a toothed driving belt 31, and gate G2 is driven by a synchronous motor 32. Gate G3 is driven by a second synchronous motor 33, though it would be possible to drive gate G3 from a single motor driving all three gates.

Between gate G1 and chamber C1 are feed rollers 34 and 35, roller 34 being urged by means of a spring 36 onto roller 35 and roller 35 being driven through a worm wheel 37 by means of a motor 38.

Motor 38 also drives through a crank or eccentric 39 an agitator plate 40 which is within chamber C1.

A fan and fan motor is provided within casing 42 secured to the frame of the developer 30 which is arranged to feed drying air via a pipe 43 into the lower chamber C2.

The gate G1 is mounted for rotation together with a rotary valve V1. The valve V1 rotates within a valve body B1 which are three inlets, namely a developer inlet D, a fixer inlet F and a water inlet W1. Water inlet W1 further communicates with a groove Z in the valve body B1. The valve V1 is provided with a port P extending radially from a central duct Y to the periphery of the valve V1. The central duct Y is in communication with a diametral slot S1 in gate G1. The diametral slot S1 communicates between entry E and chamber C1 via a semi-circular groove R in an alignment position. The operation of gate G1 and valve V1 will be further described with reference to FIG. 6A to G.

Gate G2 is provided with a chordial gating slot S2 which opens and closes communication between chambers C1 and C2, and a porting slot S3 which opens and shuts a drain DR1. The operation of gate G2 will be further described with reference to FIG. 6A to G.

Gate G3 is attached to a rotary valve V2 which rotates within a valve body B2. The gate G3 has a chordial slot S4 which opens chamber C2 to exit X. Valve V2 has an arcuate porting groove M which provides, when aligned, communication between a water inlet W2 in valve body B2 and a water outlet W3, also in the valve body B2. The outlet W3 is in communication with a water inlet W4 in chamber C2 by means of a pipe 44. Also in the valve body B2 is a drain outlet DR2 which is permanently open to chamber C2. The operation of gate G3 and valve V2 will be described with reference to FIG. 7A to D.

Chamber C2 is provided with an air inlet A in communication with pipe 43 and blows, when required, drying air down ducts 46 and 47 and angled ports 48 and 49 (see FIG. 4) into chamber C2. Also in communication with ducts 46 and 47 is water inlet W4. The angling of the ducts assists in flushing the film from chamber C2 to exit X and supports the film away from the sides of chamber C2.

Control of the fan motor and agitator motor 38 is achieved by means of cams 50 and 51 respectively, which are coupled to gates G3 and G1 respectively.

Figure 6:
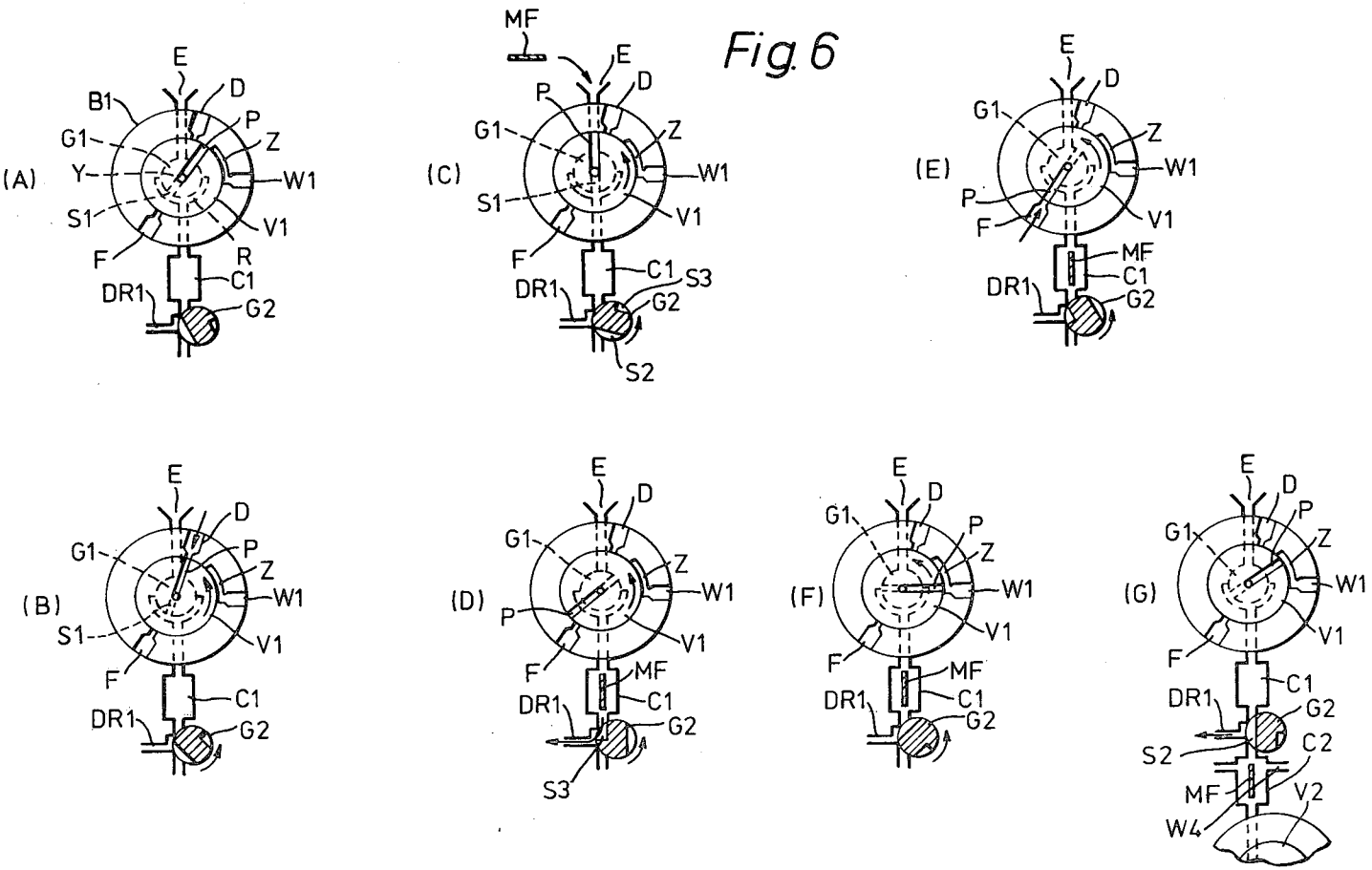

The operation of the second developer will now be described with reference to FIGS. 6A to G and 7A to D. In FIG. 6A gates G1 and G2, together with valve V1, which is coupled to gate G1, are shown in a standby position. To insert a film, preferably a microfiche, but which can be any sheet film, such as an X-ray film, the film is presented to entry E, the developer is switched on and the gates rotate so that valve V1 aligns its port P with developer inlet D. The developer is then injected into chamber C1 as shown in FIG. 6B. The gates and valve then continue to rotate closing off the developer inlet D until slot S1 in gate G1 aligns between the entry E and chamber C1, as shown in FIG. 6C, The film MF is then fed through gate G1 by means of rollers 34 and 35 into chamber C1. During this period the agitator plate 40 is operated and the gates G1 and G2 and valve V1 rotate to the position shown in FIG. 6D. At which point gate G2 opens drain DR1 and the developer is drained and recovered for further use. In FIG. 6E the next position of rotation is shown in which port P in valve V1 aligns with the fixer inlet F and a metered quantity of fixer is injected into chamber C1. Fixing continues until valve V1 rotates to the position shown in FIG. 6F, when port P in valve V1 aligns with water inlet W1. Water is then injected into chamber C1 and drained via drain DR1 which is opened by gate G2. This provides a first washing operation for the microfiche. It may also be possible at this stage to recover some of the fixer from drain DR1. The initial washing action continues the length of groove Z until slot S2 in gate G2 is aligned between chambers C1 and C2, as shown in FIG. 6G. The film MF then drops into chamber C2, partly assisted by flushing water from W1. The flushing water from W1 is allowed to drain through DR2, as shown in FIG. 7A.

Figure 7:
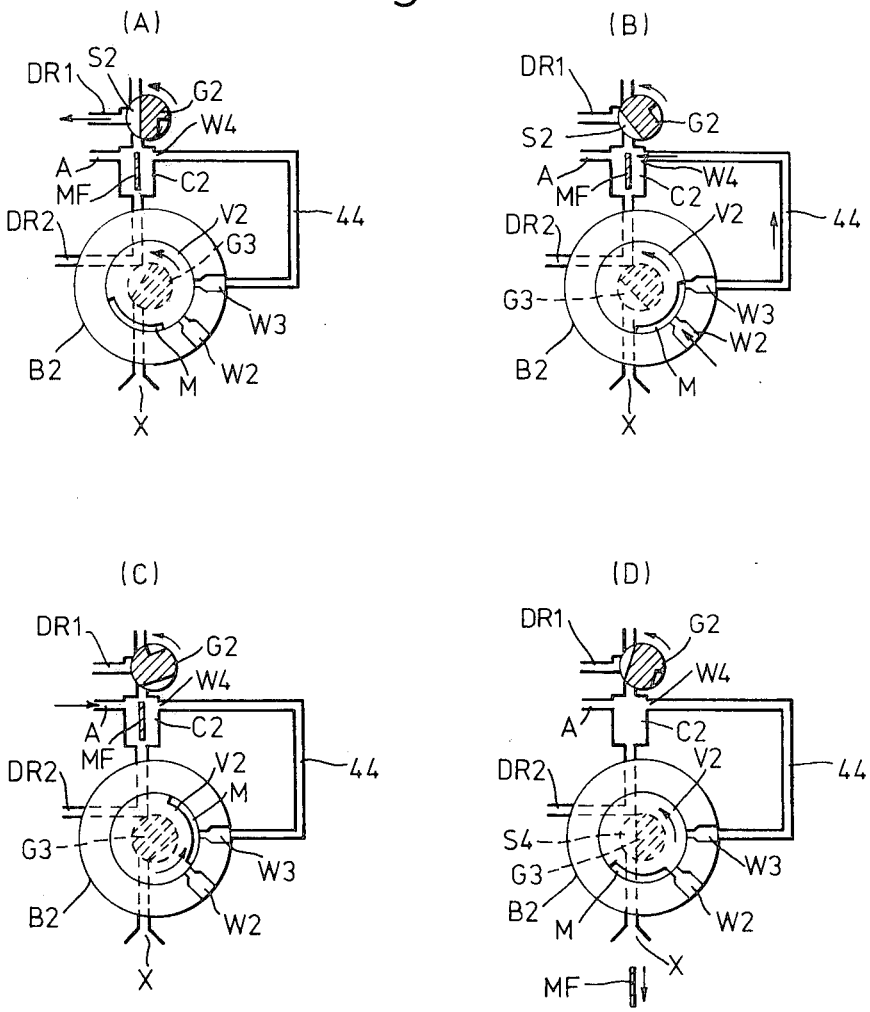

FIG. 7A to D shows a second part of the developing operation, which is the final washing and drying of the film. FIG. 7A shows the film MF having just arrived in chamber C2, and FIG. 7B shows the opening of inlet W2 and outlet W3, connected by groove M in valve V2. Water passes from outlet W3 through pipe 44 to water inlet W4 in chamber C2. The final washing stage is then carried out until the position shown in FIG. 7C, and the washing water finally drains through drain DR2. The fan in casing 42 is then switched on by means of cam 50 and air is passed through inlet A into chamber C2, and out through drain DR2. The air drying is then completed by the stage reached in FIG. 7D, at which point slot S4 in gate G3 aligns between chamber C2 and exit X so that the film MF is blown through gate G3 to the exit X.

Whilst the developer is very suitable for the developing of microfiche laminae, any suitable sheet film, such as X-ray film, may be developed by the developer, which is entirely automatic in operation.

The present developers are particularly suitable for use with high speed microfiche cameras where the flow of microfiches to be developed is constant and at a fairly high rate. The developer units can be incorporated within a microfiche camera.

The water supply for the washing processes is preferably coupled direct to the domestic water supply mains so that any requirement for pumping water is obviated. However, if domestic water supplies are not available an additional water supply tank can be provided with pressure suitably adjusted to a pressure comparable to that of domestic supplies.

Development of the film may be carried out by means of a liquid born developing agent, or a gas born developing agent.

Furthermore, it is possible to use a gas born fixing agent or a liquid born fixing agent.

The advantages of using gas born developing and fixing agents in the developers according to the invention is that the drying by means of a drying gas may be carried out in a shorter time than when liquid born developing and fixing agents are used.

I claim:

1. A photographic developer comprising in combination:

a first film receiving chamber, a second film receiving chamber in intercommunication with said first chamber, a fluid seal separating said chambers, a first chamber inlet seal, a second chamber outlet seal, wherein at least one of said seals comprises a rotatable gate formed as a cylinder with a longitudinal cut away section forming a passage through which film may be passed and wherein said chambers have fluid inlets for feeding fluids therethrough.

2. A developer as claimed in claim 1 wherein said first chamber is above said second chamber and is aligned therewith so that a film being developed may be fed downwards from chamber to chamber past said fluid seal.

3. A developer as claimed in claim 1 wherein said seals at either end of the chambers are constructed so as to be rotatable by at least one motor, which motor or motors synchronously drive valve assemblies for controlling the feed of liquid into said chambers.

4. A developer as claimed in claim 3 wherein said valve assemblies are connected to and provided at one end of each rotatable seal.

5. A developer as claimed in claim 1 wherein at least one chamber is provided with an agitator.

6. A developer as claimed in claim 1 wherein at least one chamber is provided with a plurality of fluid supply ducts entering said chamber on opposed sides.

7. A developer as claimed in claim 6 wherein at least some of said fluid supply ducts are angled to said chamber so as to direct said fluid entering the chamber in a direction towards said film outlet of said chamber.

8. A developer as claimed in claim 1 including a fan arranged to blow a drying gas through at least one chamber.

* * * * *